US005997133A

United States Patent [19]

Takemoto et al.

[11] Patent Number: 5,997,133

[45] Date of Patent: Dec. 7, 1999

[54] INKJET RECORDING APPARATUS HAVING A MINIMUM NUMBER OF EJECTION ELECTRODE DRIVING CIRCUITS AND METHOD FOR DRIVING SAME

[75] Inventors: Hitoshi Takemoto; Tadashi Mizoguchi; Junichi Suetsugu; Hitoshi Minemoto; Kazuo Shima; Yoshihiro Hagiwara; Toru Yakushiji, all of Niigata, Japan

[73] Assignee: NEC Corporation, Japan

[21] Appl. No.: 08/975,399

[22] Filed: Nov. 20, 1997

[30] Foreign Application Priority Data

Nov. 21, 1996 [JP] Japan ..... 8-310439
Nov. 26, 1996 [JP] Japan ..... 8-315124

[51] Int. Cl.[6] ..... B41J 2/06

[52] U.S. Cl. ..... 347/55

[58] Field of Search ..... 347/55, 154, 103, 347/123, 111, 159, 127, 128, 141, 120, 151, 17

[56] References Cited

U.S. PATENT DOCUMENTS 5,559,586 9/1996 Wada ..... 347/55
5,619,234 4/1997 Nagato et al. ..... 347/55

FOREIGN PATENT DOCUMENTS 8-49266 3/1983 Japan .
58-96571 6/1983 Japan .
59-22762 2/1984 Japan .
8-197724 8/1996 Japan .
93 11866 6/1993 WIPO .

*Primary Examiner*—John Barlow
*Assistant Examiner*—Raquel Yvette Gordon
*Attorney, Agent, or Firm*—Ostrolenk, Faber, Gerg & Soffen, LLP

[57] ABSTRACT

An inkjet recording apparatus includes K ejection electrodes and M counter electrodes which are located at a distance from and opposed to the K ejection electrodes. A first voltage pulse is applied to a selected one of N groups of ejection electrodes each group formed by electrically connecting an $i^{th}$ ($1 \leqq i \leqq N$) ejection electrode for each counter electrode to each other and a second voltage pulse is applied to a selected one of the M counter electrodes. A voltage difference is generated between a group and a counter electrode which are selected from the N groups and the M counter electrodes depending on an input signal, wherein the voltage difference is equal to or greater than a minimum voltage difference which causes ejection of ink from an ejection electrode.

29 Claims, 7 Drawing Sheets

INKJET RECORDING APPARATUS HAVING A MINIMUM NUMBER OF EJECTION ELECTRODE DRIVING CIRCUITS AND METHOD FOR DRIVING SAME

BACKGROUND OF THE INVENTION

1. Field of the Invention

The present invention relates to an inkjet recording apparatus which is capable of ejecting particulate matter such as pigment matter and toner matter by making use of an electric field, and more particularly to control the inkjet recording apparatus.

2. Description of the Related Art

There has recently been a growing interest in non-impact recording methods, because noise while recording is extremely small to such a degree that it is negligible. Particularly, inkjet recording methods are extremely effective in that they are structurally simple and that they can perform high-speed recording directly onto ordinary medium. One such example of the inkjet recording methods is an electrostatic inkjet recording method.

The electrostatic inkjet recording apparatus generally has an electrostatic inkjet recording head and a counter electrode which is disposed behind the recording medium to form an electric field between it and the recording head. The electrostatic inkjet recording head has an ink chamber which temporarily stores ink containing toner particles and a plurality of ejection electrodes formed near the end of the ink chamber and directed toward the counter electrode. The ink near the front end of the ejection electrode forms a concave meniscus due to its surface tension, and consequently, the ink is supplied to the front end of the ejection electrode. If positive voltage relative to the counter electrode is supplied to a certain ejection electrode of the head, then the particulate matter in ink will be moved toward the front end of that ejection electrode by the electric field generated between the ejection electrode and the counter electrode. When the coulomb force due to the electric field between the ejection electrode and the counter electrode considerably exceeds the surface tension of the ink liquid, the particulate matter reaching the front end of the ejection electrode is jetted toward the counter electrode as an agglomeration of particulate matter having a small quantity of liquid, and consequently, the jetted agglomeration adheres to the surface of the recording medium. Thus, by applying pulses of positive voltage to a desired ejection electrode, agglomerations of particulate matter are jetted in sequence from the front end of the ejection electrode, and printing is performed. A recording head such as this is disclosed, for example, in PCT International Publication No. WO93/11866.

According to the conventional inkjet recording head, however, the respective ejection electrodes are independently driven by drivers supplying driving voltages depending on input data (see FIG. 4 and page 9, lines 21–31, of the above publication No. WO93/11866). Especially, in the case of a multi-head having an array of dozens of heads or a line head having a linear array of hundreds to thousands of ejection electrodes, it is necessary to provide as many driver circuits as there are ejection electrodes, resulting in complicated circuit configuration and the increased amount of hardware. This causes the size and cost of the recording apparatus to be increased.

Further, variations in the positions and shapes of the ejection electrodes inevitably occur in practical manufacturing processes. In such cases, an amount of pigment matter (or toner matter) ejected from one ejection electrode is different from that of another ejection electrode even when the same driving voltage is applied to them, resulting in deteriorated quality of an image formed on a recording medium. More specifically, in the case where an ejection electrode has a more acute tip angle, the electric field is more likely to be concentrated thereon. Therefore, a increased amount of pigment matter is ejected from that ejection electrode, resulting in a larger ink dot formed on a recording paper. Similarly, in the case of variations in distance between an ejection electrode and the counter electrode, the smaller the distance, the larger the ink dot. Furthermore, the electric field is more likely to be concentrated on the ejection electrodes located at both ends, which causes the ink dots at both ends to increase in size. Such variations in ink dot size become more pronounced with the number of ejection electrodes.

SUMMARY OF THE INVENTION

An objective of the present invention is to provide an inkjet apparatus which can eject ink from a plurality of ejection electrodes with precision and with a reduced amount of hardware.

Another objective of the present invention is to provide an apparatus which can reduce the number of ejection electrode drivers.

Further another objective of the present invention is to provide an inkjet recording apparatus and a control method therefor which can achieve a high quality image.

Still another objective of the present invention is to provide an inkjet recording apparatus and a control method therefor which can eject a uniform amount of ink from each of a plurality of ejection electrodes.

According to the present invention, there are provided a first number K (K is an integer) of first electrodes each for ejecting an aggregation of particulate matter in a predetermined direction and a counter electrode located at a distance from the K first electrodes in the predetermined direction, wherein the counter electrode is divided into a second number M (M is an integer smaller than K) of second electrodes. A selected one of N (N is an integer) groups into which the K first electrodes are divided and a selected one of the M second electrodes are driven to cause ejection of a desired first electrode specified by a selected one of the N groups and a selected one of the M second electrodes.

The N groups may be obtained by dividing the K first electrodes in a different way from the M second electrodes. A selected one of the N groups and a selected one of the M second electrodes are driven to generate a voltage difference between them depending on an input signal, wherein the voltage difference is equal to or greater than a minimum voltage difference which causes ejection of ink from a first electrode.

Further, there may be provided an adjuster for adjusting second voltage pulse depending on which one is selected from the M second electrodes so as to provide a substantially uniform amount of ejected particulate matter and applying an adjusted second voltage pulse to the selected one of the M second electrodes. The adjuster may adjust one or both of a pulse width and a voltage of the second voltage pulse.

BRIEF DESCRIPTION OF THE DRAWINGS

The above and other objects and advantages will become apparent from the following detailed description when read in conjunction with the accompanying drawings wherein.

DETAILED DESCRIPTION OF THE PREFERRED EMBODIMENTS

Figure 1:
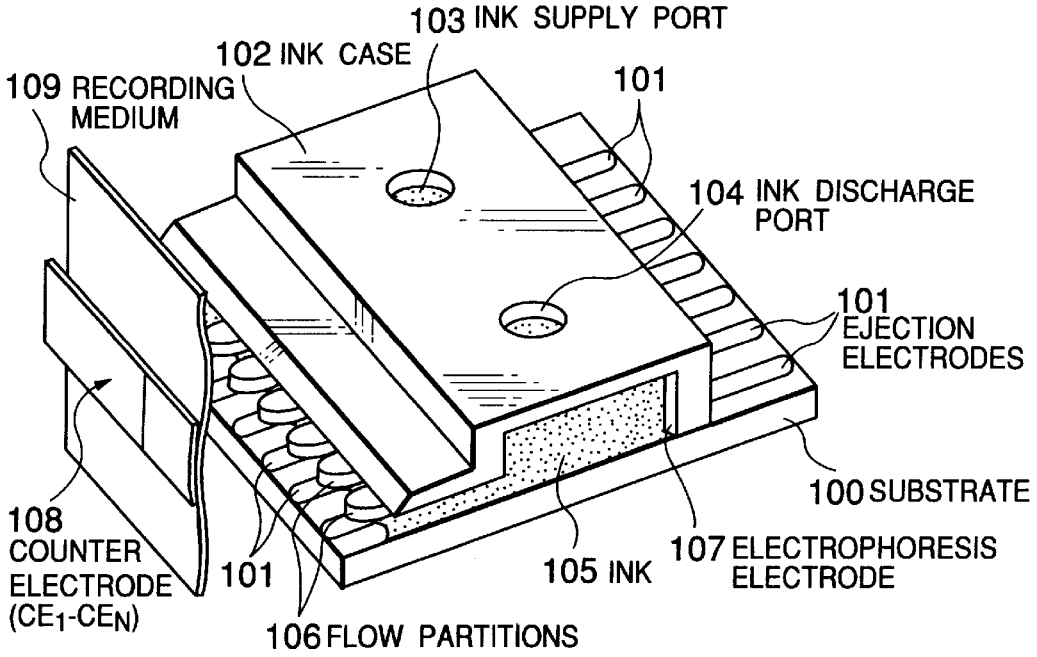
FIG. 1 is a part-fragmentary perspective view showing an inkjet head of an inkjet recording apparatus according to the present invention.

Referring to FIG. 1, there is shown an electrostatic inkjet recording head to which the present invention can be applied. A substrate 100 is made of an insulator such as plastic and has a plurality of ejection electrodes 101 formed thereon in accordance with a predetermined pattern. An ink case 102 made of an insulating material is mounted on the substrate 100. The ink case 102 is formed with an ink supply port 103 and an ink discharge port 104. The space, defined by the substrate 100 and the ink case 102, constitutes an ink chamber which is filled with ink 105 containing toner particles which is supplied through the ink supply port 103. The front end of the ink case 102 is formed with a slit with flow partitions 106 between the ink case 102 and the substrate 100. The ejection portions of the ejection electrodes 101 are disposed in the slit.

At the inner rear end of the ink case 102, an electrophoresis electrode 107 is provided in contact with the ink 105 within the ink chamber. A counter electrode plate 108 which is divided into a plurality of counter electrodes $CE_1$–$CE_N$ is provided at a distance from the front ends of the ejection electrodes 101. On the counter electrode plate 108, a recording medium such as paper is placed.

When a voltage $V_D$ is applied to the electrophoresis electrode 107 and a counter electrode driving voltage $V_{CE}$ ($<V_D$) is applied to a selected counter electrode $CE_i$, an electric field will be generated in the ink chamber, causing toner particles to be moved toward the front ends of the ejection electrodes 101 due to the electrophoresis phenomenon to form meniscuses at the front ends of the ejection electrodes 101. In this state, when a driving voltage $V_{EE}$ which is higher than $V_{CE}$ is applied to a selected ejection electrode to generate a voltage difference more than a threshold between the selected ejection electrode and the selected counter electrode $CE_i$, a small aggregation of particulate matter is jetted from the selected ejection electrode toward the selected counter electrode $CE_i$, resulting in an ink dot adhering to the recording medium 109.

FIRST EMBODIMENT

Figure 2:
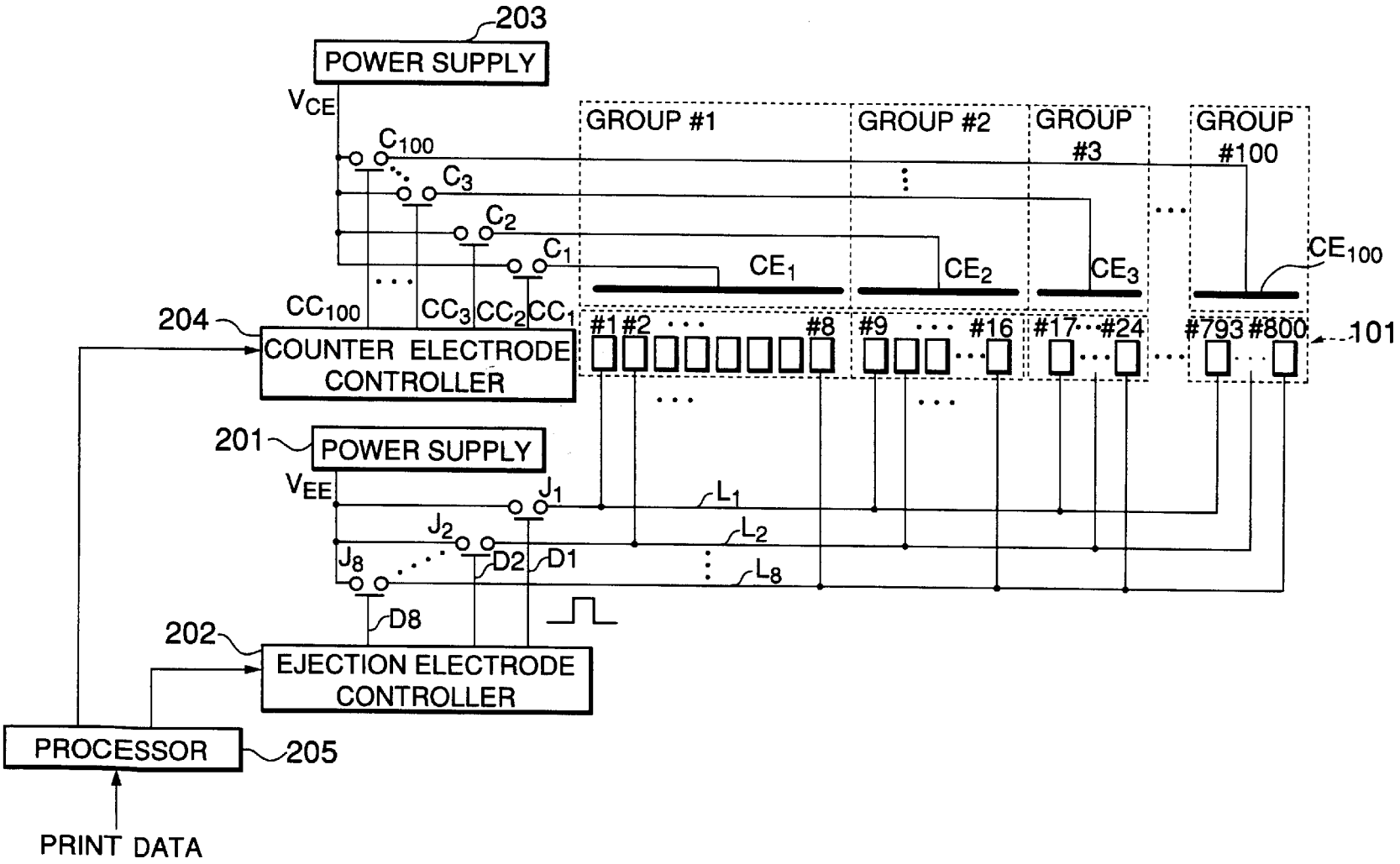
FIG. 2 is a block diagram showing a circuit configuration of the inkjet recording apparatus according to a first embodiment of the present invention.

FIG. 2 shows a circuit of a first embodiment according to the present invention, where elements of the inkjet device similar to those previously described with reference to FIG. 1 are denoted by the same reference numerals. In the first embodiment, the counter electrode plate 108 are divided into one hundred counter electrodes $CE_1$–$CE_{100}$, that is, one hundred groups #1–#100. In this example, there are eight hundred ejection electrodes 101 numbered #1–#800, where a hundred groups of eight ejection electrodes correspond to the groups #1–#100, respectively. For example, the first eight ejection electrodes #1–#8 form a first group corresponding to the group #1, the second eight ejection electrodes #9–#16 form a second group corresponding to the group #2, and so on.

Further, the ejection electrodes 101 are electrically divided into eight ejection electrode groups such that the eight ejection electrodes for each group #1–#100 are connected to driving lines $L_1$–$L_8$, respectively. More specifically, the first ejection electrode for each group is connected in common to a driving line $L_1$. That is, the ejection electrodes #1, #9, #17, . . . #793 are connected in common to the driving line $L_1$. The second ejection electrode for each group is connected in common to a driving line $L_2$. That is, the ejection electrodes #2, #10, #18, . . . #794 are connected in common to the driving line $L_2$. It is the same with the third to eighth ejection electrodes for each group.

The driving lines $L_1$–$L_8$ are connected to a power source 201 through driver switches $J_1$–$J_8$, respectively. The respective driver switches $J_1$–$J_8$ receive electrode control signals $D_1$–$D_8$ from an ejection electrode controller 202. The driver switches $J_1$–$J_8$ switch on and off depending on the ejection electrode control signals $D_1$–$D_8$, respectively. The power source 201 generates the driving voltage $V_{EE}$ which is supplied to the driver switches $J_1$–$J_8$. Therefore, depending on the ejection electrode control signals $D_1$–$D_8$, the driving voltage $V_{EE}$ is selectively applied to the driving lines $L_1$–$L_8$.

The counter electrodes $CE_1$–$CE_{100}$ are connected to a power source 203 through counter electrode driver switches $C_1$–$C_{100}$, respectively. The respective driver switches $C_1$–$C_{100}$ receive counter electrode control signals $CC_1$–$CC_{100}$ from a counter electrode controller 204. The driver switches $C_1$–$C_{100}$ switch on and off depending on the counter electrode control signals $CC_1$–$CC_{100}$, respectively. The power source 203 generates the counter electrode driving voltage $V_{CE}$ ($<V_{EE}$) which is supplied to the driver switches $C_1$–$C_{100}$. Therefore, depending on the control signals $CC_1$–$CC_{100}$, the driving voltage $V_{CE}$ is selectively applied to the counter electrodes $CE_1$–$CE_{100}$.

Ink ejection from an ejection electrode requires that a voltage difference between the ejection electrode and the corresponding counter electrode $CE_i$ is equal to or greater than a predetermined threshold value $V_{th}$. In other words, when the voltage difference is not smaller than the threshold value $V_{th}$, an aggregation of toner matter is ejected from that ejection electrode toward the counter electrode $CE_i$. If the voltage difference is smaller than the threshold value $V_{th}$, the ink ejection from that ejection electrode cannot occur. Therefore, by controlling the voltage difference between a selected ejection electrode and a selected counter electrode, an aggregation of particulate matter is selectively ejected from the ejection electrodes 101.

The ejection electrode controller 202 and the counter electrode controller 204 are controlled by a processor 205 performing image formation control according to input print data. The details of the control will be described hereinafter.

Figure 3:
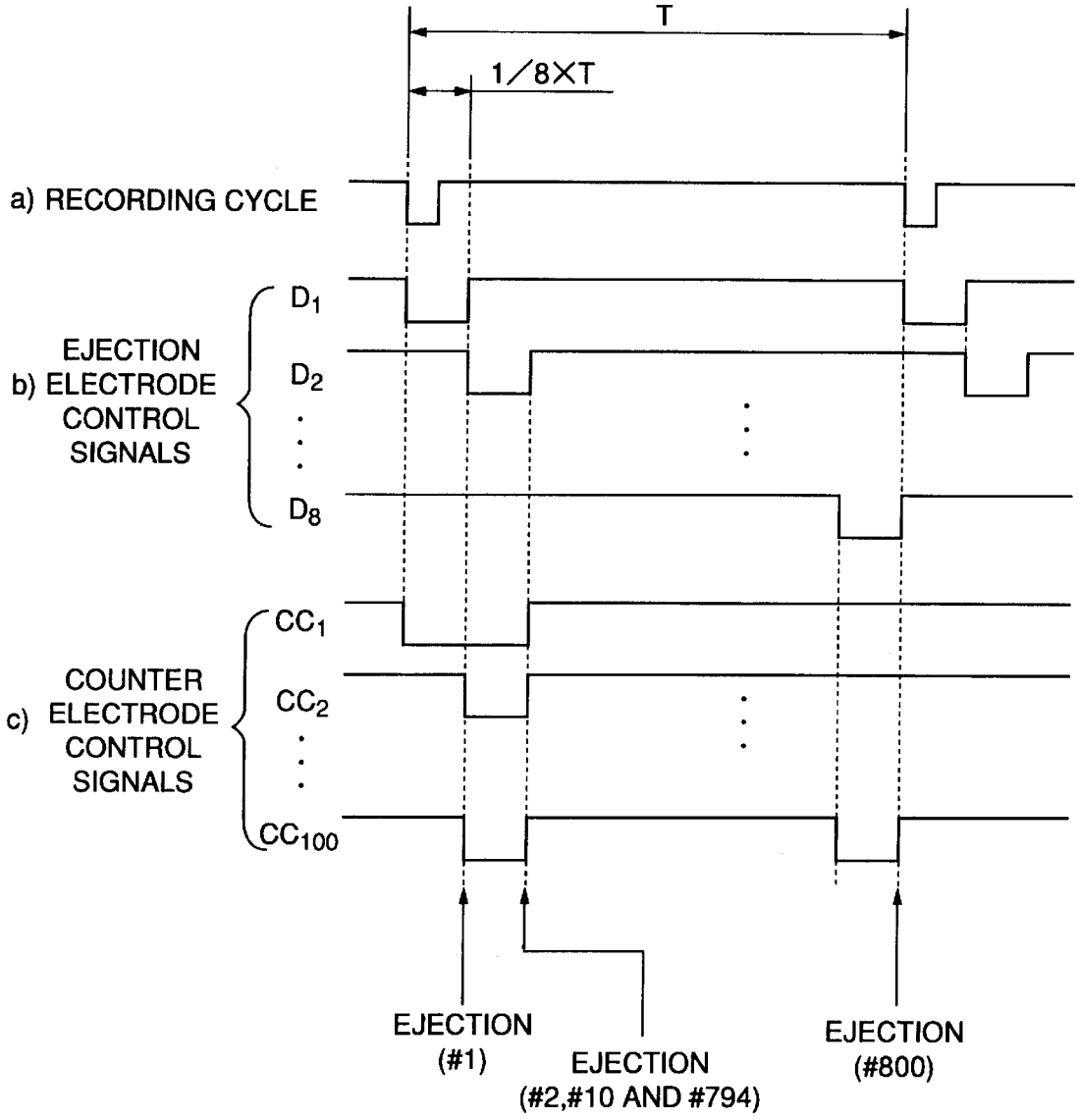
FIG. 3 is a time chart showing control signals for ejection electrodes and counter electrodes of the inkjet recording apparatus according to the first embodiment.

Referring to FIG. 3, the ejection electrode controller 202 sequentially outputs the electrode control signals $D_1$–$D_8$ to the driver switches $J_1$–$J_8$, respectively, during a recording period T. The pulse width of each electrode control signal is set to a time slot obtained by dividing the recording period T by the number of the electrode control signals $D_1$–$D_8$. In other words, the recording period T is time-divided into eight time slots each having a time period of T/8. In parallel with the ejection electrode controller 202, the counter electrode controller 204 selectively outputs the counter electrode control signals $CC_1$–$CC_{100}$ to the driver switches $C_1$–$C_{100}$, respectively, under the control of the processor 205. In this embodiment, the pulse width of each counter electrode control signal is set to one time slot.

More specifically, when receiving a recording timing pulse from the processor 205, the ejection electrode controller 202 generates the electrode control signals $D_1$–$D_8$ in sequence as shown in b) of FIG. 3. For example, when the electrode control signal $D_1$ falls on the falling edge of the recording timing pulse, the driver switch $J_1$ is closed to apply the voltage $V_{EE}$ to the ejection electrodes #1, #9, #17, . . . #793 through the driving line $L_1$. When the electrode control signal $D_2$ falls after the electrode control signal $D_1$ has risen, the voltage $V_{EE}$ is applied to the ejection electrodes #2, #10, #18, . . . #794 through the driving line $L_2$. It is the same with other electrode control signals $D_3$–$D_8$.

When the counter electrode control signal $CC_1$ falls on the falling edge of the recording timing pulse, the counter electrode driver switch $C_1$ is closed to apply the counter electrode driving voltage $V_{CE}$ to the first counter electrode $CE_1$ of the group #1. Since the voltage $V_{EE}$ is applied to the ejection electrodes #1, #9, #17, . . . #793 during the first time slot, a voltage difference $V_{EE}$–$V_{CE}$ which is greater than the threshold voltage $V_{th}$ is generated between the first ejection electrode #1 and the corresponding counter electrode $CE_1$ of the group #1. Therefore, on the rising edge of the ejection electrode control signal $D_1$, the ink is ejected only from the first ejection electrode #1.

Subsequently, when the electrode control signal $D_2$ falls in the second time slot, the driver switch $J_2$ is closed to apply the voltage $V_{EE}$ to the ejection electrodes #2, #10, #18, . . . #794 through the driving line $L_2$. In the same time slot, when the counter electrode control signals $CC_1$, $CC_2$ and $CC_{100}$ fall, the counter electrode driver switches $C_1$, $C_2$and $C_{100}$ are closed to apply the counter electrode driving voltage $V_{CE}$ to the counter electrodes $CE_1$, $CE_2$ and $CE_{100}$. Since the voltage $V_{EE}$ is applied to the ejection electrodes #2, #10, #18, . . . #794 during the second time slot, the voltage difference $V_{EE}$–$V_{CE}$ is generated between the ejection electrodes #2, #10 and #794 and the corresponding counter electrodes $CE_1$, $CE_2$ and $CE_{100}$. Therefore, on the rising edge of the ejection electrode control signal $D_2$, ink is ejected from each of the ejection electrodes #2, #10 and #794. Similarly, when the ejection electrode control signal $D_8$ and the counter electrode control signal $CC_{100}$ fall in the last time slot, only the last ejection electrode #800 ejects the ink.

As described above, only a total of one hundred and eight driver circuits including one hundred driver switches $C_1$–$C_{100}$ and eight driver switches $J_1$–$J_8$ can drive the eight hundreds ejection electrodes #1–#800.

The present invention is not limited to the combination of the 100 counter electrode driver switches and the 8 ejection electrode driver switches as shown in FIG. 2. Other combinations may be possible. For example, in a combination of 50 counter electrode driver switches and 16 ejection electrode driver switches, only a total of sixty-six driver circuits can also drive the eight hundred ejection electrodes #1–#800. In the case of 25 counter electrode driver switches and 32 ejection electrode driver switches, the minimum number of required driver circuits is realized. In summary, if the number of ejection electrodes to be driven is K, the number of counter electrode driver switches is M, and the number of ejection electrode driver switches is N, then the total number (M+N) is minimized when both M and N are equal to the square root of K. Since both M and N are integral numbers, a pair of integral numbers M and N which are closest to the square root of K is a solution.

SECOND EMBODIMENT

Figure 4:
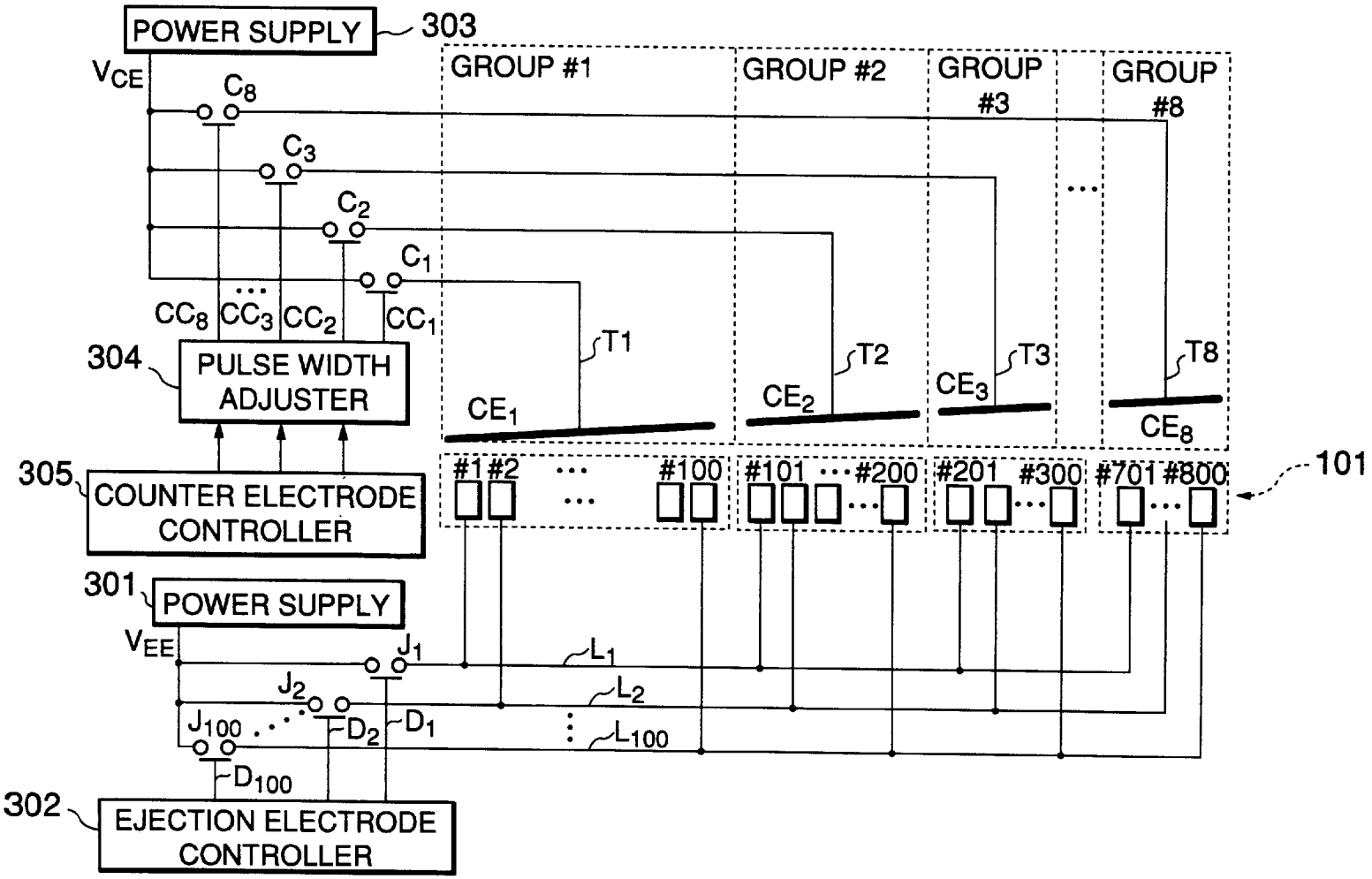
FIG. 4 is a block diagram showing a circuit configuration of the inkjet recording apparatus according to a second embodiment of the present invention.

FIG. 4 shows a circuit of a second embodiment according to the present invention, where elements of the inkjet device similar to those previously described with reference to FIG. 2 are denoted by the same reference numerals. Here, it is assumed that the counter electrode plate 108 is not parallel with the array of the ejection electrodes 101 due to variations in the position and shape of the counter electrode plate 108 or the array of the ejection electrodes 101. Here, for simplicity, the distance between each ejection electrode and the corresponding counter electrode are changed with the number of ejection electrode. For example, the distance L1 at one end between the first ejection electrode #1 and the corresponding counter electrode is shorter than the distance L2 at the other end between the last ejection electrode #800 and the corresponding counter electrode. Such variations cause variations in the amount of ejected ink from each electrode. In the second embodiment, variations in amount of ejected ink can be eliminated by adjusting the pulse width of a counter electrode control signal as will be described later.

As shown in FIG. 4, the counter electrode plate 108 is divided into eight counter electrodes $CE_1$–$CE_8$ of eight groups, #1–#8. There are eight hundred ejection electrodes 101, numbered, #1–#800, where eight groups of the hundred ejection electrodes correspond to the groups #1–#8, respectively. For example, the ejection electrodes #1–#100 form a first group corresponding to the group #1, the ejection electrodes #101–#200 form a second group corresponding to the group #2, and so on.

Further, the ejection electrodes 101 are electrically divided into one hundred ejection electrode groups such that the hundred ejection electrodes for each group are connected to driving lines $L_1$–$L_{100}$, respectively. More specifically, the first ejection electrode for each group is connected in common to a driving line $L_1$. That is, the ejection electrodes #1, #101, #201, . . . #701 are connected in common to the driving line $L_1$. The second ejection electrode for each group is connected in common to a driving line $L_2$. That is, the ejection electrodes #2, #102, #202, . . . #702 are connected in common to the driving line $L_2$. It is the same with the third to hundredth ejection electrodes for each group.

The driving lines $L_1$–$L_{100}$ are connected to a power supply 301 through driver switches $J_1$–$J_{100}$, respectively. The respective driver switches $J_1$–$J_{100}$ receive electrode control signals $D_1$–$D_{100}$ from an ejection electrode controller 302. The driver switches $J_1$–$J_{100}$ switch on and off depending on the ejection electrode control signals $D_1$–$D_{100}$, respectively. The power source 301 generates the driving voltage $V_{EE}$ which is supplied to the driver switches $J_1$–$J_{100}$. Therefore, depending on the ejection electrode control signals $D_1$–$D_{100}$, the driving voltage $V_{EE}$ is selectively applied to the driving lines $L_1$–$L_{100}$.

The counter electrodes $CE_1$–$CE_8$ are connected to a power supply 303 through counter electrode driver switches $C_1$–$C_8$, respectively. The respective counter electrode driver switches $C_1$–$C_8$ receive adjusted control signals $CC_1$–$CC_8$ from a pulse width adjuster 304 which receives control signals from a counter electrode controller 305. The pulse width adjuster 304 generates the adjusted control signals $CC_1$–$CC_8$ each having a pulse width which is adjusted so as to cancel the effect due to the variations in position and shape of the counter electrode plate 108 or the of ejection electrodes 101. More specifically, the respective adjusted control signals $CC_1$–$CC_8$ have pulse widths T1–T8 corresponding to the counter electrodes $CE_1$–$CE_8$.

The counter electrode driver switches $C_1$–$C_8$ switch on and off depending on the adjusted control signals $CC_1$–$CC_8$, respectively. The power supply 303 generates the counter electrode driving voltage $V_{CE}$ ($<V_{EE}$) which is supplied to the counter electrode driver switches $C_1$–$C_8$. Therefore, depending on the adjusted control signals $CC_1$–$CC_8$, the counter electrode driving voltage $V_{CE}$ is selectively applied to the counter electrodes $CE_1$–$CE_8$.

As described before, the voltage $V_{EE}$ applied to the ejection electrodes 101 is lower than the threshold value $V_{th}$ but the voltage difference ($V_{EE}$–$V_{CE}$) is equal to or greater than the threshold value $V_{th}$. Therefore, by producing the voltage difference ($V_{EE}$–$V_{CE}$) between a selected counter electrode and a selected ejection electrode group, the ink can be ejected from a desired ejection electrode. Further, an adjusted pulse width of each voltage pulse applied to the corresponding counter electrode can provide a uniform amount of ejected ink even in the case where there are variations in distance between each ejection electrode and the corresponding counter electrode.

The ejection electrode controller 302 and the counter electrode controller 305 are controlled by the processor 205 (not shown in this figure) performing image formation control according to input print data. The details of the control will be described hereinafter.

Figure 5:
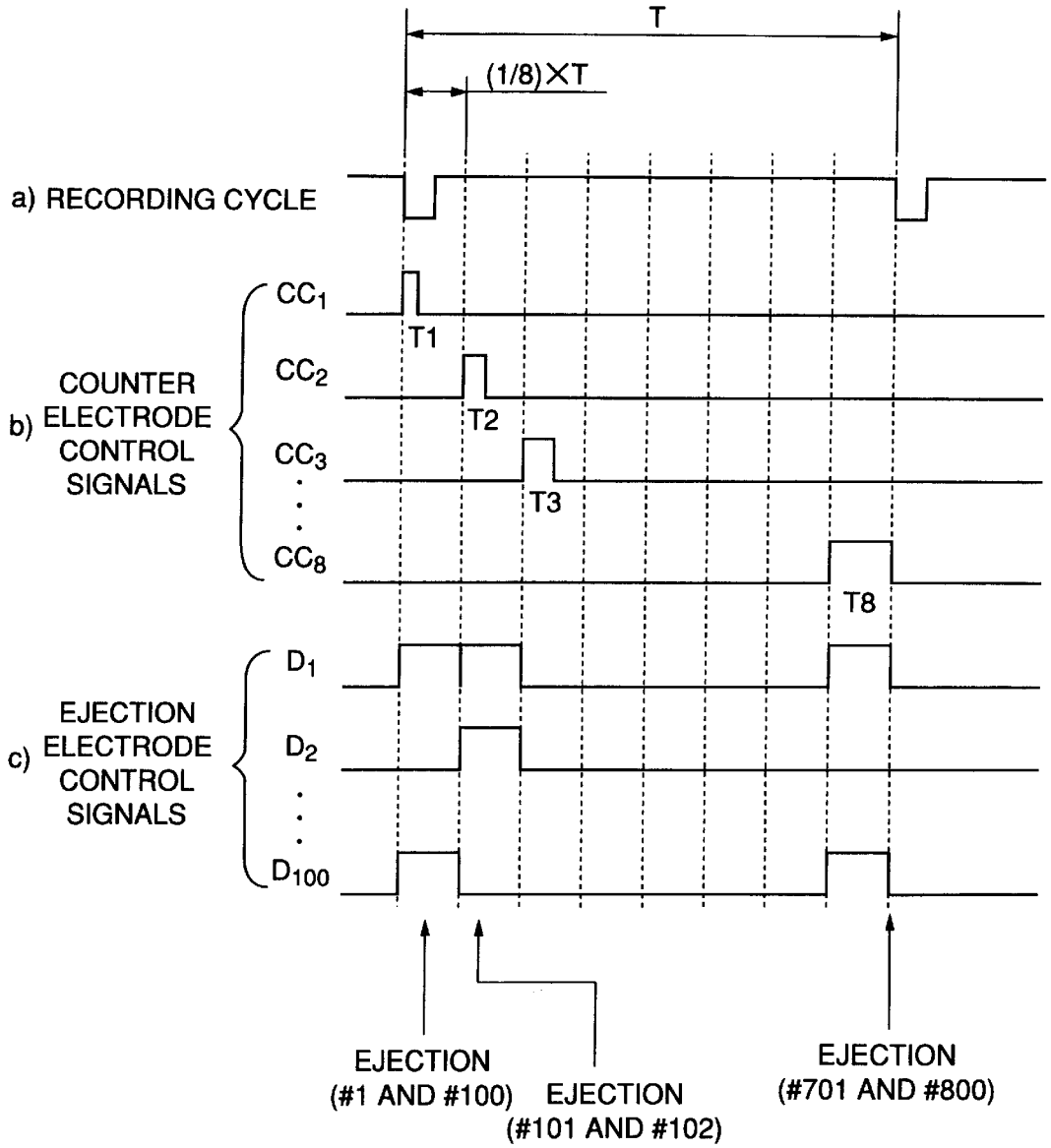
FIG. 5 is a time chart showing control signals for ejection electrodes and counter electrodes of the inkjet recording apparatus according to the second embodiment.

Referring to FIG. 5, the counter electrode controller 305 sequentially outputs the control signals to the pulse width adjuster 304 which in turn outputs the counter electrode control signals $CC_1$–$CC_8$ to the counter electrode driver switches $C_1$–$C_8$, respectively, during a recording period T. The pulse width of each control signal generated by the counter electrode controller 305 is set to a time slot obtained by dividing the recording period T by the number of the counter electrodes $CE_1$–$CE_8$. In other words, the recording period T is time-divided into eight time slots each having a time period of T/8. The pulse width adjuster 304 generates the counter electrode control signals $CC_1$–$CC_8$ which correspond to the control signals, respectively, with each counter electrode control signal changing in pulse width within a time slot of T/8.

More specifically, as shown in b) of FIG. 5, the respective pulse widths of the counter electrode control signals $CC_1$–$CC_8$ are set to time periods T1–T8 which become longer in the order presented, that is, T1<T2<T3<T4<T5<T6<T7<T8<T/8 . As described before, the pulse width of each counter electrode control signal is adjusted so as to provide a uniform amount of ejected ink from each ejection electrode. Therefore, the pulse widths may be changed depending on variations in the positions and shapes of the counter electrode plate 108 and of the ejection electrodes 101.

In parallel with the pulse width adjuster 304 and the counter electrode controller 305, the ejection electrode controller 302 selectively outputs the ejection electrode control signals $D_1$–$D_{100}$ to the driver switches $J_1$–$J_{100}$, respectively, under the control of the processor. In this embodiment, the pulse width of each ejection electrode control signal is set to less than T/8.

More specifically, when receiving a recording timing pulse from the processor, the counter electrode controller 305 generates the control signals in sequence, which cause the pulse width adjuster 304 to generate the counter electrode control signals $CC_1$–$CC_8$ whose pulse widths are adjusted as shown in b) of FIG. 5. For example, when the counter electrode control signal $CC_1$ of T1 rises on the falling edge of the recording timing pulse, the counter electrode driver switch $C_1$ is closed to apply the voltage $V_{CE}$ to the counter electrode $CE_1$ during the time period T1. When the counter electrode control signal $CC_2$ of T2 rises after the counter electrode control signal $CC_1$ has fallen, the voltage $V_{CE}$ is applied to the counter electrode $CE_2$ during the time period T2. It is the same with other gate control signals $CC_3$–$CC_8$.

When the ejection electrode control signals $D_1$ and $D_{100}$ rise on the falling edge of the recording timing pulse, the driver switches $J_1$ and $J_{100}$ are closed during the first time slot to apply the driving voltage $V_{EE}$ to the ejection electrodes #1, #101, #201, . . . #701 and the ejection electrodes #100, #200, . . . #800 through the driving lines $L_1$ and $L_{100}$, respectively. Since the voltage $V_{CE}$ is applied to the counter electrode $CE_1$ during the time period T1, the voltage difference $V_{EE}$–$V_{CE}$ which is greater than the threshold voltage $V_{th}$ is generated between each of the ejection electrodes #1 and #100 and the counter electrode $CE_1$. Therefore, on the falling edge of the counter electrode control signal $CC_1$, ink is ejected only from the ejection electrodes #1 and #100.

Subsequently, when the counter electrode control signal $CC_2$ rises in the second time slot, the counter electrode driver switch $C_2$ is closed during the time period T2 to apply the voltage $V_{CE}$ to the counter electrode $CE_2$. When the ejection electrode control signals $D_1$ and $D_2$ rise in the second time slot, the driver switches $J_1$ and $J_2$ are closed during the second time slot to apply the driving voltage $V_{EE}$ to the ejection electrodes #1, #101, #201, . . . #701 and the ejection electrodes #2, #102, . . . #702 through the driving lines $L_1$ and $L_2$, respectively. Since the voltage $V_{CE}$ is applied to the counter electrode $CE_2$ during the time period T2, the voltage difference $V_{EE}$–$V_{CE}$ which is greater than the threshold voltage $V_{th}$ is generated between each of the ejection electrodes #101 and #102 and the counter electrode $CE_2$. Therefore, on the falling edge of the counter electrode control signal $CC_2$, ink is ejected only from the ejection electrodes #101 and #102. Similarly, when the counter electrode control signal $CC_8$ and the ejection electrode control signals $D_1$ and $D_{100}$ rise in the last time slot, only the ejection electrodes #701 and #800 eject ink.

THIRD EMBODIMENT

Figure 6:
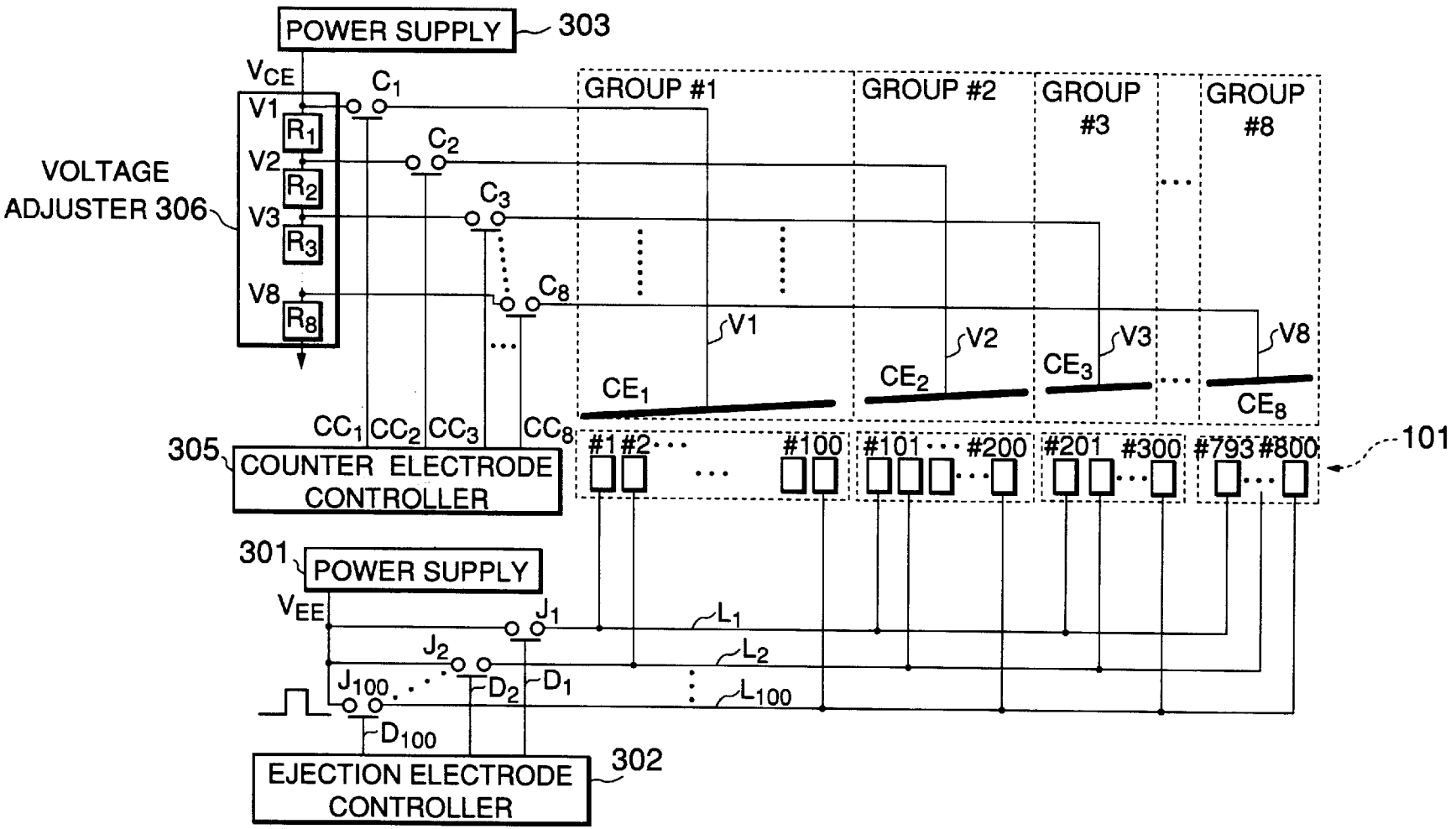
FIG. 6 is a block diagram showing a circuit configuration of the inkjet recording apparatus according to a third embodiment of the present invention.

FIG. 6 shows a circuit of a third embodiment according to the present invention, where elements of the inkjet device similar to those previously described with reference to FIG. 4 are denoted by the same reference numerals and their details are omitted. As in the case of the second embodiment, it is also assumed that the counter electrode plate 108 is not parallel with the array of the ejection electrodes 101 due to variations in the positions and shapes of the counter electrode plate 108 and the array of the ejection electrodes 101. In the third embodiment, variations in the amount of ejected ink can be substantially eliminated by adjusting a voltage applied to each counter electrode as will be described later.

Referring to FIG. 6, there is provided a voltage adjuster 306 connecting the power supply 303 and the counter electrode driver switches $C_1$–$C_8$. The voltage adjuster 306 is composed of a voltage divider having resistors $R_1$–$R_8$ connected in series to divide the counter electrode driving voltage $V_{CE}$ into eight counter electrode voltages V1–V8. In this embodiment, the counter electrode driving voltages V1–V8 become lower in the order presented, that is, $V_{EE}>V_{CE}=V1>V2>V3>V4>V5>V6>V7>V8$. Therefore, the voltage difference ($V_{EE}$–V1) between the counter electrode $CE_1$ and the ejection electrode #1 in the smallest and a voltage difference ($V_{EE}$–V8) between the counter electrode $CE_1$ and the ejection electrode #800 is the largest. The uneven counter electrode driving voltages as described herein can reduce variations in electric field between an ejection electrode and the corresponding counter electrode, resulting in a substantially uniform amount of ejected ink from each ejection electrode.

Since the counter electrode driving voltages V1–V8 are adjusted so as to provide a uniform amount of ejected ink, the distribution of the counter electrode driving voltages V1–V8 may be changed depending on variations in the positions and shapes of the counter electrode plate 109 and the ejection electrodes 101. The counter electrode driver switches $C_1$–$C_8$ switch on and off depending on the counter electrode control signals $CC_1$–$CC_8$ received from the counter electrode controller 305 and apply the adjusted counter electrode driving voltages V1–V8 to the counter electrodes $CE_1$–$CE_8$, respectively.

Figure 7:
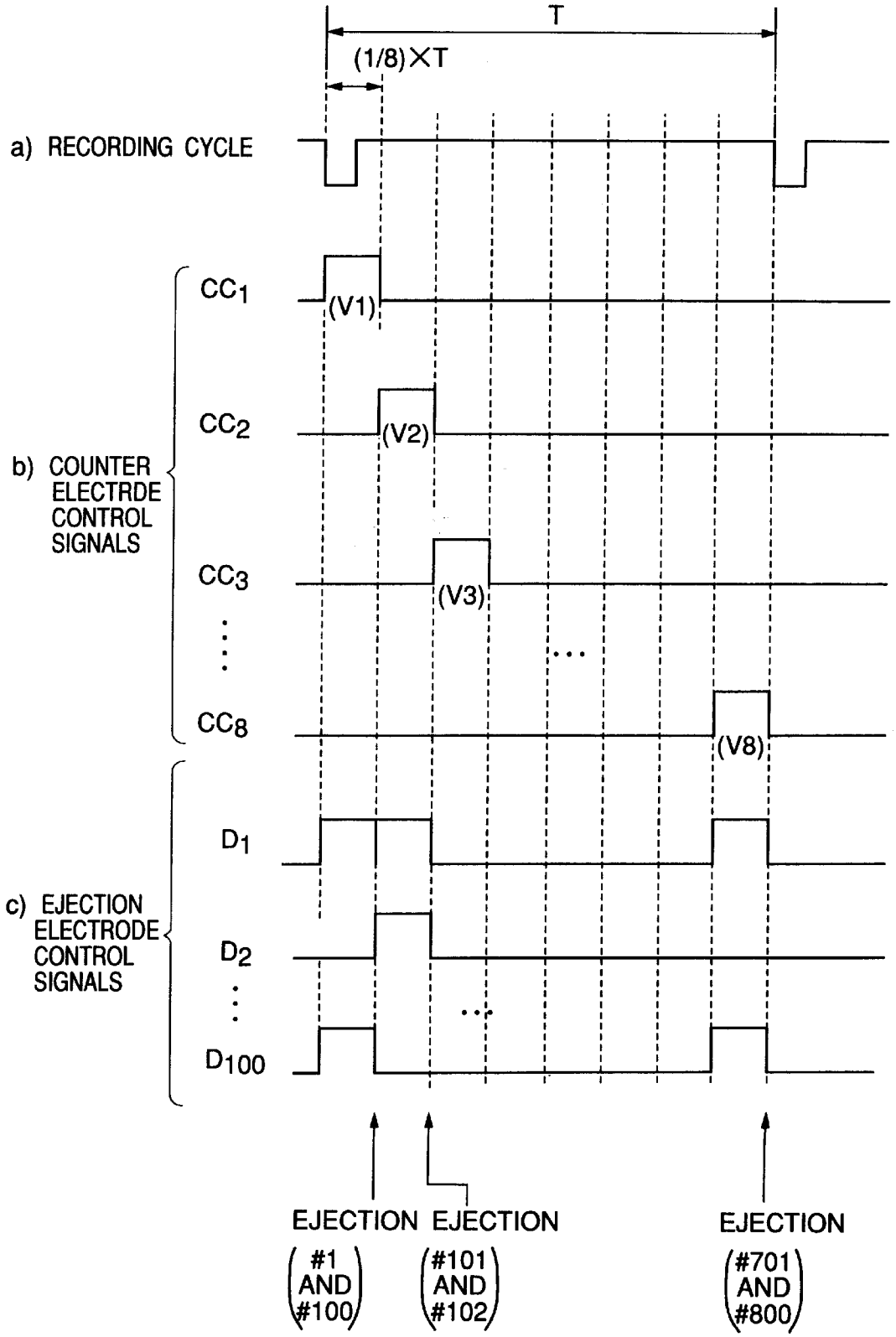
FIG. 7 is a time chart showing control signals for ejection electrodes and counter electrodes of the inkjet recording apparatus according to the third embodiment.

Referring to FIG. 7, the counter electrode controller 305 sequentially outputs the counter electrode control signals $CC_1$–$CC_8$ to the counter electrode driver switches $C_1$–$C_8$, respectively, during a recording period T. The pulse width of each counter electrode control signal is set to a time slot obtained by dividing the recording period T by the number of counter electrodes $CE_1$–$CE_8$. In other words, the recording period T is time-divided into eight time slots each having a time period of T/8. In parallel with the counter electrode controller 305, the ejection electrode controller 302 selectively outputs the ejection electrode control signals $D_1$–$D_{100}$ to the driver switches $J_1$–$J_{100}$, respectively, under the control of the processor. In this embodiment, the pulse width of each ejection electrode control signal is also set to T/8.

More specifically, when receiving a recording timing pulse from the processor, the counter electrode controller 305 generates the counter electrode control signals $CC_1$–$CC_8$ in sequence as shown in b) of FIG. 7. For example, when the counter electrode control signal $CC_1$ rises on the falling edge of the recording timing pulse, the counter electrode driver switch $C_1$ is closed to apply the voltage V1 ($=V_{CE}$) to the counter electrode $CE_1$ during the first time slot. When the counter electrode control signal $CC_2$ rises after the counter electrode control signal $CC_1$ has fallen, the voltage V2 (<V1) is applied to the counter electrode $CE_2$ during the second time slot. It is the same with other counter electrode control signals $CC_3$–$CC_8$.

When the ejection electrode control signals $D_1$ and $D_{100}$ rise on the falling edge of the recording timing pulse, the driver switches $J_1$ and $J_{100}$ are closed during the first time slot to apply the driving voltage $V_{EE}$ to the ejection electrodes #1, #101, #201, . . . #701 and the ejection electrodes #100, #200, . . . #800 through the driving lines $L_1$ and $L_{100}$, respectively. Since the voltage V1 is applied to the counter electrode $CE_1$, the voltage difference $V_{EE}$–V1 which is greater than the threshold voltage $V_{th}$ is generated between each of the ejection electrodes #1 and #100 and the counter electrode $CE_1$. Therefore, on the falling edge of the ejection electrode control signals $D_1$ and $D_{100}$, the ink is ejected only from the ejection electrodes #1 and #100.

Subsequently, when the counter electrode control signal $CC_2$ rises in the second time slot, the counter electrode driver switch $C_2$ is closed to apply the voltage V2 to the counter electrode $CE_2$. When the ejection electrode control signals $D_1$ and $D_2$ rise in the second time slot, the driver switches $J_1$ and $J_2$ are closed during the second time slot to apply the driving voltage $V_{EE}$ to the ejection electrodes #1, #101, #201, . . . #701 and the ejection electrodes #2, #102, . . . #702 through the driving lines $L_1$ and $L_2$, respectively. Since the voltage V2 is applied to the counter electrode $CE_2$ during the second time slot, the voltage difference $V_{EE}$–V2 which is greater than the threshold voltage $V_{th}$ is generated between each of the ejection electrodes #101 and #102 and the counter electrode $CE_2$. Therefore, ink is ejected only from the ejection electrodes #101 and #102. Similarly, when the counter electrode control signal $CC_8$ and the ejection electrode control signals $D_1$ and $D_{100}$ rise in the last time slot, only the ejection electrodes #701 and #800 eject ink.

In the second embodiment, variations in the amount of ejected ink can be substantially eliminated by adjusting the pulse width of a counter electrode control signal. In the third embodiment, variations in the amount of ejected ink can be substantially eliminated by adjusting the voltage applied to each counter electrode. As a fourth embodiment, a combination of the second and third embodiments may be possible. That is, variations in the amount of ejected ink can be substantially eliminated by adjusting both the pulse width and the voltage of a voltage pulse applied to a counter electrode.

The present invention is not limited to the combination of the 8 counter electrode driver switches and the 100 ejection electrode driver switches as shown in FIGS. 4 and 6. Another combination may be possible as in the case of FIG. 2. However, in the second and third embodiments, the pulse width adjuster 304 and the voltage adjuster 306 are needed, respectively. Therefore, it may be preferable that the number of driver switches in the side of the pulse width adjuster 304 or the voltage adjuster 306 is smaller than that of driver switches in the other side.

While the invention has been described with reference to specific embodiments thereof, it will be appreciated by those skilled in the art that numerous variations, modifications, and any combination of the first, second and third disclosed embodiments are possible, and accordingly, all such variations, modifications, and combinations are to be regarded as being within the scope of the invention.

What is claimed is:

1. An apparatus comprising:

K first electrodes each for ejecting an aggregation of particulate matter in a predetermined direction, wherein the K first electrodes are divided into N groups of first electrodes, and wherein K and N are integers greater than one and N is less than K;

a counter electrode located at a distance from the K first electrodes in the predetermined direction, wherein the counter electrode is divided into M second electrodes, wherein M is an integer smaller than K and greater than one;

a first driving controller for driving electrodes of a selected one of the N groups into which the K first electrodes are divided; and a second driving controller for driving a selected one of the M second electrodes, wherein ejection of particulate matter from a desired first electrode in the predetermined direction toward the counter electrode is caused by driving the electrodes of a selected one of the N groups and a selected one of the M second electrodes.

2. The apparatus according to claim 1, further comprising a predetermined time period divided into N equal time slots, wherein the first driving controller sequentially selects one by one from the N groups and drives the electrodes of each selected group in a corresponding one of the N equal time slots, and wherein the second driving controller drives at least one of the M second electrodes in each time slot to cause the ejection of particulate matter from at least one first electrode.

3. The apparatus according to claim 1, further comprising a predetermined time period divided into N equal time slots, wherein the second driving controller sequentially selects one by one from the M second electrodes and drives each selected second electrode in a corresponding one of the N equal time slots, and wherein the first driving controller drives the electrodes of at least one of the N groups in each time slot to cause the ejection of particulate matter from at least one first electrode.

4. The apparatus according to claim 1, wherein M and N are determined to be two integers which are closest to the square root of K.

5. An apparatus comprising:

K first electrodes each for ejecting an aggregation of particulate matter in a predetermined direction, wherein the K first electrodes are divided into N groups of first electrodes, and wherein K and N are integers greater than one and N is less than K;

a counter electrode located at a distance from the K first electrodes in the predetermined direction, wherein the counter electrode is divided into M second electrodes opposing the K first electrodes with each second electrode being opposed to one first electrode in each of the N groups of first electrodes, wherein M is an integer smaller than K and greater than one and K is equal to a product of N multiplied by M;

a first driving controller for producing a first voltage pulse to be applied to the electrodes of a selected one of the N groups into which the K first electrodes are divided;

a second driving controller for producing a second voltage pulse to be applied to a selected one of the M second electrodes; and a controller for controlling the first and second driving controllers to generate a voltage difference between the electrodes of the selected one of the N groups and the selected one of the M second electrodes, wherein the voltage difference is equal to or greater than a minimum voltage difference which causes ejection of particulate matter from a first electrode in the predetermined direction toward the counter electrode.

6. The apparatus according to claim 5, wherein each of the N groups is formed by electrically connecting an $i^{th}$ ($1 \leqq i \leqq N$) first electrode opposing each second electrode to each other.

7. The apparatus according to claim 5, wherein the second driving controller comprises:

an adjuster for adjusting the second voltage pulse depending on which one is selected from the M second electrodes so as to provide a substantially uniform amount of ejected particulate matter and applying an adjusted second voltage pulse to the selected one of the M second electrodes.

8. The apparatus according to claim 7, wherein the adjuster is a pulse width adjuster for adjusting a pulse width of the second voltage pulse.

9. The apparatus according to claim 7, wherein the adjuster is a voltage adjuster for adjusting a voltage of the second voltage pulse.

10. The apparatus according to claim 7, wherein the adjuster adjusts a pulse width and a voltage of the second voltage pulse.

11. The apparatus according to claim 7, further comprising a predetermined time period divided into N equal time slots, wherein the first driving controller sequentially selects one by one from the N groups and applies the first voltage pulse to the electrodes of each selected group in a corresponding one of the N equal time slots, and wherein the second driving controller applies the second voltage pulse to at least one of the M second electrodes in each time slot to cause the ejection of particulate matter from at least one first electrode.

12. The apparatus according to claim 7, further comprising a predetermined time period divided into N equal time slots, wherein the second driving controller sequentially selects one by one from the M second electrodes and applies the second voltage pulse to each selected second electrode in a corresponding one of the N equal time slots, and wherein the first driving controller applies the first voltage pulse to the electrodes of at least one of the N groups in each time slot to cause the ejection of particulate matter from at least one first electrode.

13. The apparatus according to claim 7, wherein M and N are determined to be two integers which are closest to the square root of K.

14. An electrostatic inkjet recording apparatus comprising:

K ejection electrodes each for ejecting an aggregation of particulate matter in a predetermined direction, wherein the K first electrodes are divided into N groups of ejection electrodes, and wherein K and N are integers greater than one and N is less than K;

a counter electrode plate located at a distance from the K ejection electrodes in the predetermined direction with the counter electrode plate opposing the K ejection electrodes, wherein the counter electrode plate is divided into M blocks each opposing one ejection electrode in each of the N groups, wherein M is an integer smaller than K and greater than one and K is equal to the product of N multiplied by M;

an electrophoresis electrode located at a distance from the K ejection electrodes in an opposite direction to the predetermined direction, for moving particulate matter to an ejection portion of each ejection electrode;

a first driving controller for applying a first voltage pulse to the electrodes of a selected one of the N groups, wherein each of the N groups is formed by electrically connecting an $i^{th}$ ($1 \leqq i \leqq N$) ejection electrode opposing each block to each other;

a second driving controller for applying a second voltage pulse to a selected one of the M blocks; and a processor for controlling the first and second driving controllers to generate a voltage difference between the election electrodes of the selected one of the N groups and the selected one of the M blocks, wherein the voltage difference is equal to or greater than a minimum voltage difference which causes ejection of particulate matter from an ejection electrode in the predetermined direction toward the counter electrode plate.

15. The electrostatic inkjet recording apparatus according to claim 14 further comprising a predetermined time period divided into N equal time slots, wherein the first driving controller sequentially selects one by one from the N groups and applies the first voltage pulse to the ejection electrodes of each selected group in a corresponding one of the N equal time slots, and wherein the second driving controller applies the second voltage pulse to at least one of the M blocks in each time slot to cause the ejection of particulate matter from at least one ejection electrode.

16. The electrostatic inkjet recording apparatus according to claim 14, further comprising a predetermined time period divided into N equal time slots, wherein the second driving controller sequentially selects one by one from the M blocks and applies the second voltage pulse to each selected block in a corresponding one of the N equal time slots, and wherein the first driving controller applies the first voltage pulse to the election electrodes of at least one of the N groups in each time slot to cause the ejection of particulate matter from at least one ejection electrode.

17. The electrostatic inkjet recording apparatus according to claim 14, wherein M and N are determined to be two integers which are closest to the square root of K.

18. The electrostatic inkjet recording apparatus according to claim 14, wherein the second driving controller comprises:

an adjuster for adjusting the second voltage pulse depending on which one is selected from the M blocks so as to provide a substantially uniform amount of ejected particulate matter and applying an adjusted second voltage pulse to the selected one of the M blocks.

19. The electrostatic inkjet recording apparatus according to claim 18, wherein the adjuster is a pulse width adjuster for adjusting a pulse width of the second voltage pulse.

20. The electrostatic inkjet recording apparatus according to claim 18, wherein the adjuster is a voltage adjuster for adjusting a voltage of the second voltage pulse.

21. The electrostatic inkjet recording apparatus according to claim 18, wherein the adjuster adjusts a pulse width and a voltage of the second voltage pulse.

22. A control method for an inkjet recording apparatus including K first electrodes each for ejecting an aggregation of particulate matter in a predetermined direction, wherein the K first electrodes are divided into N groups of first electrodes, K and N being integers greater than one and N is less than K and further including a counter electrode located at a distance from the K first electrodes in the predetermined direction, wherein the counter electrode is divided into M second electrodes opposing the K first electrodes with each second electrode being opposed to one first electrode in each of the N groups of first electrodes, M being an integer smaller than K and greater than one and K is equal to the product of N multiplied by M, the control method comprising the steps of:

a) selecting one of the N groups into which the K first electrodes are divided;

b) selecting one of the M second electrodes; and c) driving the electrodes of the selected one of the N groups and the selected one of the M second electrodes to eject an aggregation of particulate matter from a specified first electrode in the predetermined direction toward the selected one of the M second electrodes.

23. The control method according to claim 22, wherein the step a) comprises the steps of defining a predetermined time period and dividing the time period into N equal time slots, sequentially selecting a different one of the N groups in each of the N time slots; and the step c) comprises the step of driving at least one of the M second electrodes in each time slot.

24. The control method according to claim 22, wherein the step b) comprises the steps of defining a predetermined time period and dividing the time period into N equal time slots, sequentially selecting a different one of the M second electrodes in each of the N time slots; and the step c) comprises the step of driving the electrodes of at least one of the N groups in each time slot.

25. The control method according to claim 24, wherein the step c) comprises the steps of:

producing a driving pulse to be applied to a selected one of the M second electrodes;

adjusting the driving pulse depending on which one is selected from the M second electrodes so as to provide a substantially uniform amount of ejected particulate matter; and applying an adjusted driving pulse to the selected one of the M second electrodes.

26. The control method according to claim 25, wherein the step of adjusting the driving pulse includes adjusting a pulse width thereof.

27. The control method according to claim 25, wherein the step of adjusting the driving pulse includes adjusting a voltage thereof.

28. The control method according to claim 25, wherein the step of adjusting the driving pulse includes adjusting a pulse width and a voltage thereof.

29. The control method according to claim 22, further comprising the step of forming each of the N groups by electrically connecting an $i^{th}$ ($1 \leqq i \leqq N$) first electrode opposing each second electrode to each other.

* * * * *